United States Patent [19]

Takamatsu

[11] 3,945,405

[45] Mar. 23, 1976

[54] METHOD OF MANUFACTURING SLIDE FASTENER STRINGERS HAVING COUPLING ELEMENTS WOVEN INTO A FABRIC TAPE

[75] Inventor: Ikuo Takamatsu, Uozu, Japan

[73] Assignee: Yoshida Kogyo Kabushiki Kaisha, Japan

[22] Filed: Feb. 25, 1975

[21] Appl. No.: 552,756

[30] Foreign Application Priority Data

Feb. 27, 1974 Japan ..... 49-23115

[52] U.S. Cl. ..... 139/22; 139/116; 139/384 B; 24/205.16 C

[51] Int. Cl.[2] ..... D03D 35/00; D03D 49/50; A44B 19/42

[58] Field of Search ..... 139/1, 11, 20, 22, 23, 139/116, 384 B, 384 R; 24/205.1 C, 205.13 C, 205.16 C

[56] References Cited

UNITED STATES PATENTS 3,022,803 2/1962 Berberich et al. ..... 139/384 B 3,880,203 4/1975 Frohlich ..... 139/384 B

*Primary Examiner*—James Kee Chi

*Attorney, Agent, or Firm*—Bucknam and Archer

[57] ABSTRACT

A method of manufacturing slide fastener stringers having a row of continuous coupling elements which is spirally coiled and woven into the fabric tape simultaneously with the weaving of the latter. There is provided a shuttle for carrying an element-forming filament which is interwoven with warp yarns forming the tape edge and looped over a mandrel wire located adjacent the tape edge by reciprocal, transverse movement of the shuttle. The shuttle is rotated about its central axis during one cycle of the reciprocal movement thereof to eliminate a twist or torsion on the filament imparted by the shuttle reciprocally passing alternately over and under the mandrel wire.

5 Claims, 16 Drawing Figures

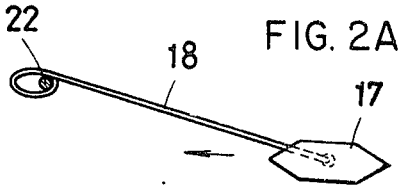
FIG. 2A
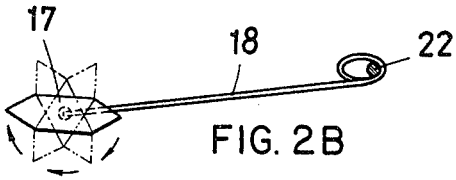
FIG. 2B
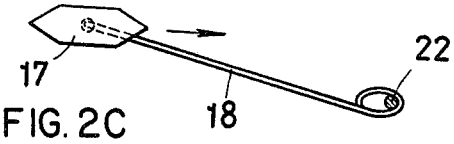
FIG. 2C
FIG. 2D
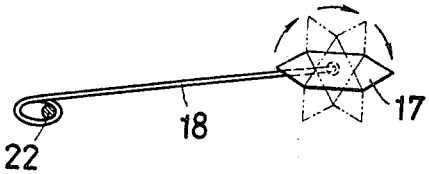
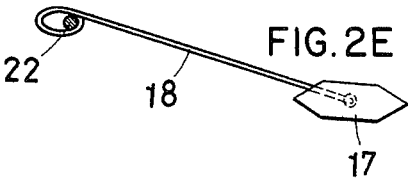
FIG. 2E

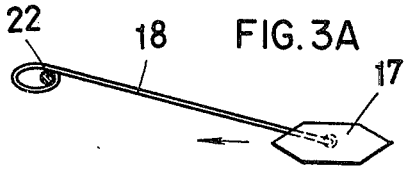
FIG. 3A
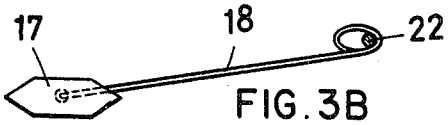
FIG. 3B
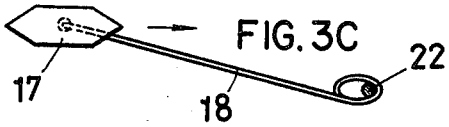
FIG. 3C
FIG. 3D
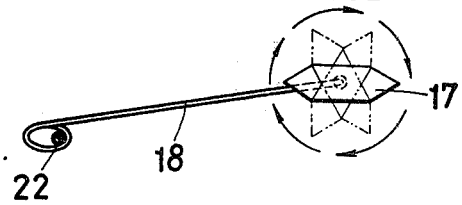
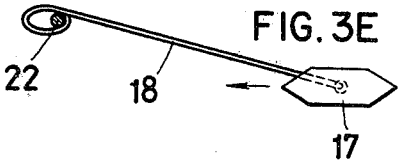
FIG. 3E

METHOD OF MANUFACTURING SLIDE FASTENER STRINGERS HAVING COUPLING ELEMENTS WOVEN INTO A FABRIC TAPE

BACKGROUND OF THE INVENTION

This invention relates to a method of manufacturing slide fastener stringers having a woven fabric tape carrying along its one longitudinal edge a row of continuous coupling elements which is formed into a spirally coiled structure and woven into the carrier tape in the course of the weaving of the latter.

In the method of manufacturing the slide fastener stringers just described, there have heretofore been used shuttle looms having a pair of shuttles, one of which serves to carry a weft yarn for forming the carrier tape fabric and the other of which carries a continuous filament for forming the coupling elements of coiled structure to be woven into the tape fabric. The shuttle carrying the element-forming filament is, during the tape weaving, reciprocally moved transversely in criss-cross relation to warp yarns for forming the tape fabric in order to enable the element-forming filament to interweave with a selected group of warp yarns during shedding of the latter which form the element-carrying edge. The element-forming filament loops over a mandrel wire located adjacent the warp yarns of the tape edge, which wire is arranged for the purpose of forming and retaining the configuration of the resulting coupling elements in the vicinity of the coupling heads. This is effected in such a manner that the filament-carrying shuttle is reciprocated alternately over and under the wire as the latter is lowered and raised in this order during the tape weaving operation. The filament-carrying shuttle known in the art has the drawback that the filament was let go twisted as it was spirally coiled to form a row of coupling elements. And, therefore, resulting coupling elements were liable to become distorted or deformed throughout the parts including a coupling head, legs and connecting portions, thereby causing a mal-functioning in the intermeshing engagement between the opposed rows of coupling elements.

SUMMARY OF THE INVENTION

With the above-noted deficiencies in mind, the principal object of this invention is to provide an improved method of producing slide fastener stringers which will eliminate the twist or torsion of an element-forming filament while the latter is spirally coiled and woven into a tape fabric simultaneously with the weaving of the latter.

Other objects and advantages of the invention will become more apparent from the following description when read in conjunction with the accompanying drawings in which like reference numerals denote like parts throughout several views.

BRIEF DESCRIPTION OF THE DRAWINGS

FIGS. 2(A) through 2(E) inclusive are schematic views showing the progressive positions of a filament-carrying shuttle relative to a mandrel wire and the manner in which the shuttle is rotated about its central axis to eliminate a filament twist in accordance with the invention;

FIGS. 3(A) through 3(E) inclusive are similar views, but showing another embodiment of the invention.

DESCRIPTION OF THE PREFERRED EMBODIMENTS

Figure 1:
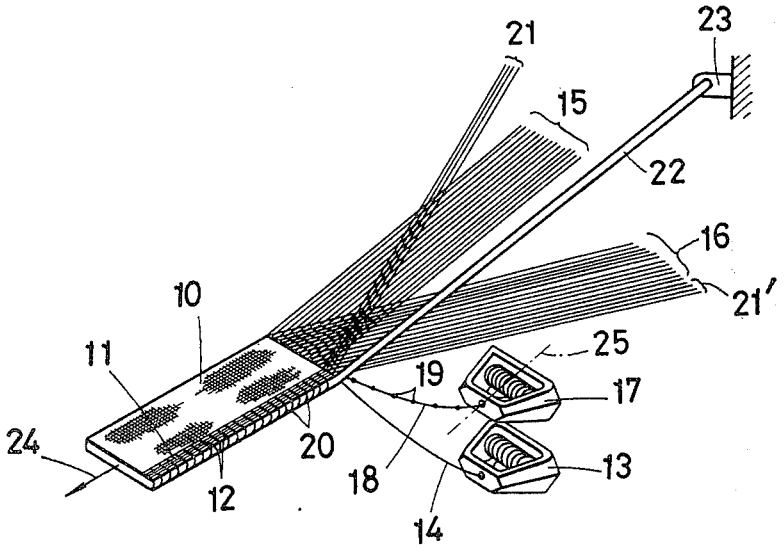
FIG. 1 is a diagrammatic perspective view of a shuttle loom having a pair of shuttles, showing the weaving operation of a fastener tape fabric into which a row of coupling elements is spirally woven simultaneously in a manner well known in the art.

Referring now to the drawings and FIG. 1 in particular, a fastener tape 10 is shown carrying along its one longitudinal edge 11 a row of continuous coupling elements 12. There is illustrated a shuttle 13 which carries a weft yarn 14 and is reciprocally passed between two groups of warp yarns 15, 16 alternately raised and lowered and between two selected groups 21,21' of warp yarns (later described) for interweaving with the coupling elements at the tape edge, so as to weave the tape fabric in the conventional manner. Designated at 17 is a shuttle which carries a continuous filament 18 made of plastics material or any other suitable material and provided thereon at predetermined spaced-apart intervals with deformations or projections 19 acting as coupling heads 20 of the resulting coupling elements 12. The shuttle 17 is also reciprocally moved in the shedding formed by the two selected groups 21,21' of warp yarns that form the longitudinal tape edge 11 into which the elements are woven and in the transverse direction of the fastener tape 10 in criss-cross relation thereto in order to allow the filament 18 to interweave the groups 21,21' of warp yarns and to loop over a mandrel wire 22 which is located adjacent the warp yarns 21 and is greater in strength and thickness than the warp yarns 15, 16 and 21. The wire 22 preferably made of a metal is fixed at one end to a vertically movable portion 23 of the loom for moving between the warp yarn groups 15 and 21 and serves to form and maintain the ultimate configuration of the coupling elements 12 in the vicinity of the coupling heads 20. In its weaving operation, the shuttle 17 is reciprocally moved over and under the wire 22 as the latter is lowered and raised to weave the filament 18 spirally into the tape fabric and to cause the filament 18 to engage the wire 22 in surrounding relation. As the weaving of the fastener tape 10 progresses, the tape 10 is withdrawn in the direction of the arrow 24.

Referring now to FIGS. 2(A) to 2(E), there is shown a preferred embodiment of the invention wherein one cycle of filament coiling operation is progressively illustrated. FIG. 2(A) indicates the filament-carrying shuttle 17 in its initial disposition. As the operation begins, the shuttle 17 is caused to move in the direction of the arrow as seen in FIG. 2(A) and go under the mandrel wire 22 toward the opposite position as shown in FIG. 2(B). It is appreciated that as the shuttle 17 moves toward and reaches the position of FIG. 2(B), it causes the filament 18 to be twisted. According to an important aspect of the invention, the shuttle 17 when held in the FIG. 2(B) position is rotated 180° about its central axis 25 (FIG. 1) in the clockwise direction as viewed in FIG. 2(B) thereby untwisting the filament 23. FIGS. 2(C) to 2(D) illustrate the returning movement of the shuttle 17 passing over the wire 22 toward the position as seen in FIG. 2(D). During this movement, the filament 18 is twisted again. In order to eliminate the twist produced on the filament 18, the shuttle 17 is further rotated 180° about its axis 25 in the clockwise direction as viewed in FIG. 2(D) to untwist the filament 18.

Accordingly, the twist as produced on the filament 18 in the filament coiling operation is completely removed at the end of every half of a cycle of this reciprocal movement of the shuttle 17. FIG. 2(E) depicts the same position as FIG. 2(A) at which the next filament coiling operation will start.

FIGS. 3(A) to 3(E) illustrate another embodiment of the invention wherein the filament 18 twisted by one complete cycle of reciprocal movement of the shuttle 17 is allowed to untwist by rotating the shuttle 17 by 360° about its central axis 25 in the clockwise direction as viewed in and at the position of FIG. 3(D). In this embodiment, the twist on the filament 18 is removed at the end of each complete cycle of reciprocal movement of the shuttle 17.

Figure 4A:
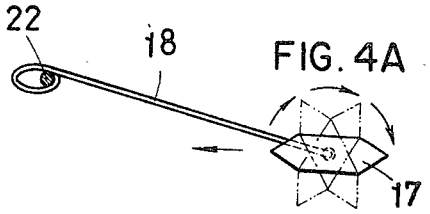
FIGS. 4(A) through 4(E) inclusive are similar views, but showing still another embodiment of the invention.
Figure 4B:
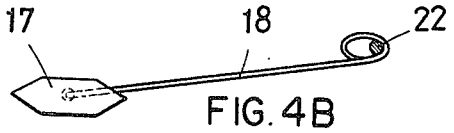
Figure 4C:
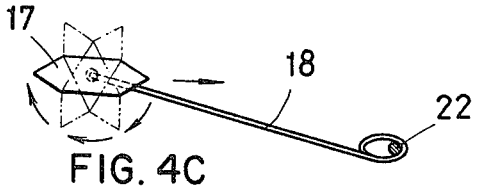
Figure 4D:
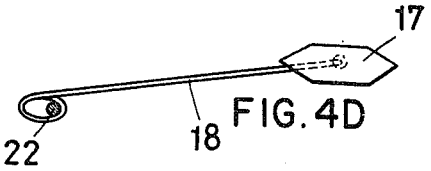
Figure 4E:
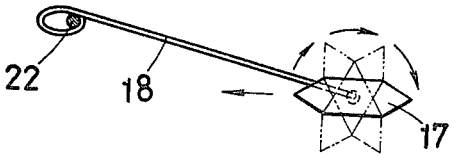

Still another embodiment of the invention is shown in FIGS. 4(A) to 4(E). FIG. 4(A) shows the initial position of the shuttle 17 at which, before initiating its transverse movement, the shuttle 17 rotates 180° about its central axis 25 in the clockwise direction as viewed in FIG. 4(A) in order to give the filament 18 a countertwist. As the shuttle 17 moves under the wire 22 toward and reaches the opposite position as shown in FIG. 4(B), it will be noted that the filament 18 is untwisted to eliminate the countertwist thereon. The filament 18 is again countertwisted at the position of FIG. 4(C) by rotating the shuttle 17 180° about its axis 25 in the clockwise direction as viewed in FIG. 4(C). Until the shuttle 17 reaches the FIG. 4(D) position, the countertwist on the filament 18 will be removed. According to this embodiment, any objectionable twist or torsion of the filament 18 during the filament coiling operation is thus prevented as the filament 18 has been imparted a countertwist at the beginning of every half cycle of reciprocal movement of the shuttle 17. Although not shown specifically, it will be understood that the countertwist given on the filament 18 at the FIG. 4(A) position may be obtained also by rotating the shuttle 17 all way up to 360° about its axis 25 in the clockwise direction as viewed in FIG. 4(A) to achieve similar results.

What is claimed is:

1. In the manufacture of slide fastener stringers having a woven fabric tape carrying along its one longitudinal edge a row of continuous coupling elements which is spirally coiled and woven into the tape fabric in the course of the tape weaving, a method comprising the steps of reciprocally moving a shuttle carrying an element-forming filament transversely in crisscross relation to warp yarns alternately over and under a mandrel wire located adjacent a selected group of warp yarns during the shedding of the latter which form a longitudinal tape edge so as to permit said filament to interweave with said group of warp yarns and to loop over said mandrel wire, and rotating said shuttle about its central axis during each cycle of its reciprocal movement thereby removing a twist on the filament imparted by said reciprocal movement of the shuttle.

2. A method of manufacturing slide fastener stringers as defined in claim 1, wherein said shuttle is rotated 180° at the end of every half cycle of the reciprocal movement of the shuttle.

3. A method of manufacturing slide fastener stringers as defined in claim 1, wherein said shuttle is rotated 360° at the end of each complete cycle of the reciprocal movement of the shuttle.

4. A method of manufacturing slide fastener stringers as defined in claim 1, wherein said shuttle is rotated 180° at the beginning of every half cycle of the reciprocal movement of the shuttle.

5. A method of manufacturing slide fastener stringers as defined in claim 1, wherein said shuttle is rotated 360° at the beginning of each complete cycle of the reciprocal movement of the shuttle.

* * * * *